US005418424A

United States Patent [19]

Aprile et al.

[11] Patent Number: 5,418,424

[45] Date of Patent: May 23, 1995

[54] VACUUM ULTRAVIOLET LIGHT SOURCE UTILIZING RARE GAS SCINTILLATION AMPLIFICATION SUSTAINED BY PHOTON POSITIVE FEEDBACK

[76] Inventors: Elena Aprile, 10 Sheldon St., Ardsley, N.Y. 10502; Danli Chen, 506 W. 113th St., New York, N.Y. 10025

[21] Appl. No.: 89,666

[22] Filed: Jul. 9, 1993

[51] Int. Cl.[6] ..... H01J 23/34

[52] U.S. Cl. ..... 315/1; 313/373

[58] Field of Search ..... 315/1; 250/493.1; 313/373, 376

[56] References Cited

U.S. PATENT DOCUMENTS 3,889,143 6/1975 Gowers ..... 313/373
4,644,221 2/1987 Guiterrez ..... 313/373
4,972,419 11/1990 Burke .

OTHER PUBLICATIONS

O. Aleksandrov et al., "A Light Source for the Vacuum Ultraviolet," Soviet Journal of Optical Technology, vol. 34, No. 5, pp. 582–584, Sep., 1967.

B. Raz et al., "Some Vacuum Aspects of Vacuum Ultraviolet Spectroscopy," Vacuum, vol. 19, No. 12, pp. 571–574, 1969.

R. E. Huffman et al., "Helium Continuum Light Source for Photoelectric Scanning in the 600–100 Å Region," Applied Optics, vol. 2, No. 6, pp. 617–623, Jun. 1963.

Z. Yu et al., "Wide Area Disk-Shaped Vacuum Ultraviolet Lamp," Applied Physics Letters, vol. 57, No. 18, pp. 1873–1875, Oct. 29, 1990.

I. Kachkurova et al., "High-Intensity Low-Voltage Tubular Lamps Containing . . . for the Vacuum Ultraviolet Region," Zhurnal Prikladnoi Spektroskopii, vol. 28, No. 4, pp. 747–750, Apr. 1978.

A. Gedanken et al., "A New Light Source in the Vacuum Ultra Violet Spectral Region," Vacuum, vol. 21, No. 9, pp. 389–391, Sep., 1971.

V. Dolgikh et al., "Efficient Vacuum-uV Luminescence of $Xe_2$* in Non-Self-Sustained and Self-Sustained Discharges," Soviet Tech. Physics Letters, vol. 14, No. 6, pp. 462–463, Jun., 1988.

K. Yoshizawa et al., "Disk-Shaped Vacuum Ultraviolet Light Source Driven by Microwave Discharge for Photoexcited Processes," vol. 59, No. 14, pp. 1678–1680, Sep. 30, 1991.

I. Nakamura et al., "Improvement of the KrF(BX) Excimer Lamp with 248 and 193 nm Dual Wavelength Emission Using an Ar Buffer," vol. 57, No. 20, pp. 2057–2059, Nov. 12, 1990.

*Primary Examiner*—Robert J. Pascal
*Assistant Examiner*—Darius Gambino

[57] ABSTRACT

A source of light in the vacuum ultraviolet (VUV) spectral region includes a reflective UV-sensitive photocathode supported in spaced parallel relationship with a mesh electrode within a rare gas at low pressure. A high positive potential applied to the mesh electrode creates an electric field which causes drifting of free electrons occurring between the electrodes and producing continuous VUV light output by electric field-driven scintillation amplification sustained by positive photon feedback mediated by photoemission from the photocathode. In one embodiment the lamp emits a narrow-band continuum peaked at 175 nm.

19 Claims, 2 Drawing Sheets

VACUUM ULTRAVIOLET LIGHT SOURCE UTILIZING RARE GAS SCINTILLATION AMPLIFICATION SUSTAINED BY PHOTON POSITIVE FEEDBACK

SPECIFICATION

This invention was made with United States Government support under a contract awarded by the National Aeronautics Space Agency (NASA). The U.S. Government has certain rights in this invention.

BACKGROUND OF THE INVENTION

This invention generally relates to light sources and, more particularly, is directed to a source of vacuum ultraviolet light, that is, light in the spectral region between 190 nm and 100 nm.

The many different types of vacuum ultraviolet (VUV) light sources heretofore proposed and commercialized are based on more or less the same lighting mechanism. For example, the mercury-xenon lamp widely used in the semiconductor industry for photolithography is based on a discharge phenomenon and therefore has a very broad emission spectrum, mainly from far UV to infrared. Its VUV continuum is weak with the result that the VUV emission efficiency is very low. There are light sources with main emission continua in VUV, for example, deuterium lamps; these are also discharge devices which utilize an arc discharge in deuterium gas at a pressure of several Torr and emit light in the short wavelength range below 400 nm. Deuterium lamps are widely used as a continuous UV spectrum in spectrophotometers, and while exhibiting a high VUV emission efficiency its radiant intensity is too low for industrial applications, such as photolithography, because of the wide spread of its spectrum produced by discharge and low pressure operation.

Another known type of VUV light source utilizes microwave excitation of a rare gas. When argon (Ar), krypton (Kr) or xenon (Xe) is excited with a microwave discharge (2450 MHz) it emits a Hopfield-type continuum peaked according to the gas used as follows: Argon, 106–150 nm; krypton, 126–170 nm; xenon, 150–200 nm. Emission continua also occur at longer wavelengths but they are comparatively weak. Although the structure of the microwave-powered lamp itself is quite simple, the microwave generator for powering the lamp is bulky and expensive and consumes large amounts of power. The radiant intensity achieved by lamps of this type typically is less than $10^{16}$ photons/second with an 800-watt generator. Due to the ionization that occurs in the discharge, the emission spectrum resembles that of rare gas discharge by other excitation methods.

A primary object of the present invention is to provide an improved VUV light source.

Another object of the invention is to provide a light source having high VUV emission efficiency.

Still another object of the invention is to provide a light source having higher radiant intensity at VUV wavelength than most VUV light source currently commercially available.

Yet another object is to provide a VUV light source of simple construction and capable of being operated with simple external circuitry, and which can, therefore, be manufactured at relatively low cost.

Another object of the invention is to provide a VUV light source having sufficiently low power consumption as to not require cooling.

SUMMARY OF THE INVENTION

Unlike the prior art devices, the VUV light source according to the present invention does not employ a gaseous discharge, instead utilizing a mechanism known as scintillation amplification in rare gases sustained by positive photon feedback. Specifically, the VUV lamp according to the invention includes a reflective ultraviolet sensitive photocathode supported in spaced parallel relationship with a collecting electrode within a closed vessel containing a rare gas at low pressure, typically a few hundred Torr. The collecting electrode preferably is in the form of a mesh. A high negative potential applied to the photocathode creates an electric field which causes drifting of free electrons occurring between the electrodes and producing continuous VUV light output by electric field-driven scintillation amplification sustained by photon positive feedback mediated by photoemission from the photocathode, without production of ions. A vessel filled with xenon gas at a pressure of 400 Torr emits a continuum peaked at 175 nm.

BRIEF DESCRIPTION OF THE DRAWINGS

Other objects, features and advantages of the invention will become apparent, and its construction and operation better understood, from the following detailed description when read in conjunction with the accompanying drawings, in which.

DESCRIPTION OF THE PREFERRED EMBODIMENT

Figure 1:
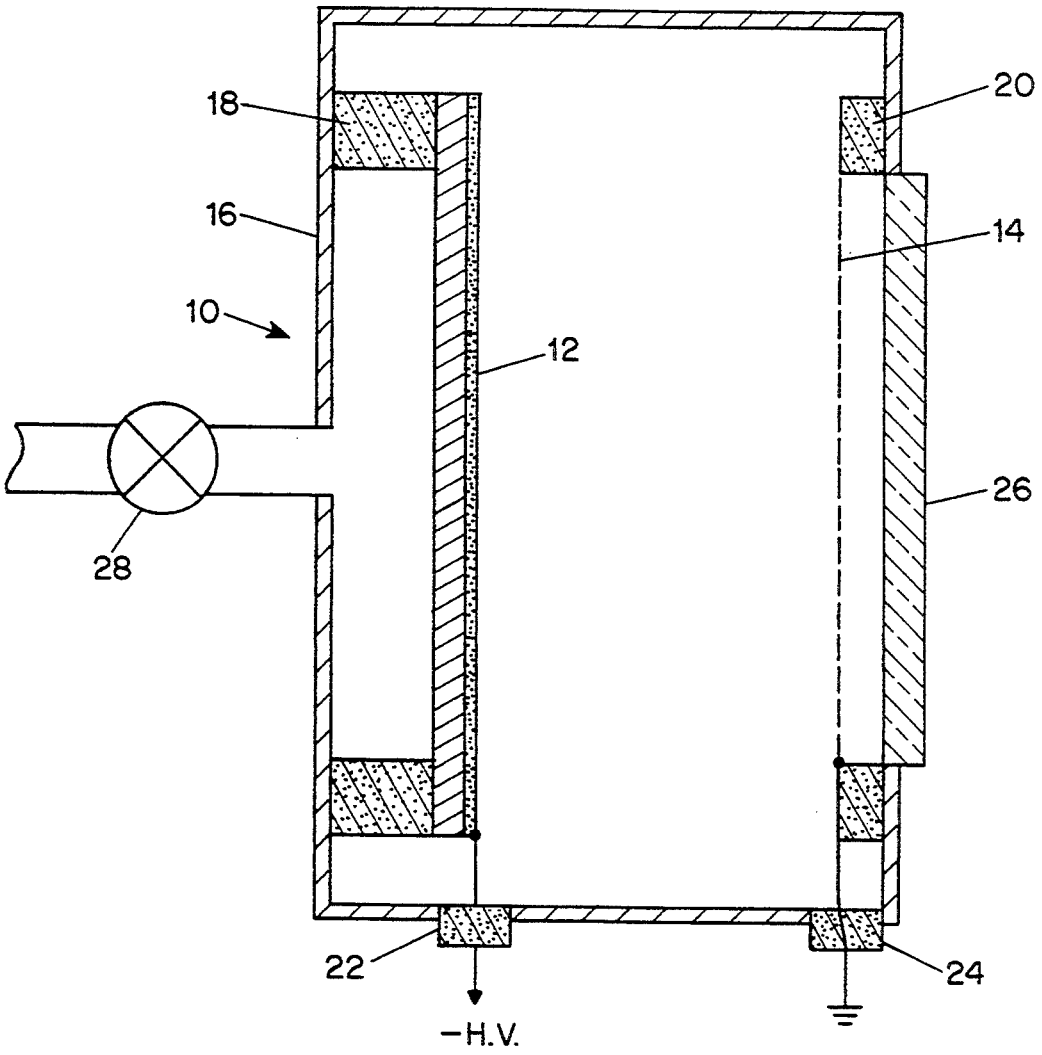
FIG. 1 is an elevation cross-section of a VUV lamp constructed in accordance with the principles of the invention.

Referring to FIG. 1, the VUV light source 10 comprises a parallel plate structure consisting of a reflective photocathode 12 facing a mesh electrode 14 spaced therefrom by a distance of a few millimeters, typically about 5 mm. The photocathode 12 preferably is circular in shape and consists of an approximately 5000A° thick layer of a photoemitting substance vacuum deposited on a stainless steel substrate. Cesium iodide (CsI), which has a long wavelength cut-off point of 200 nm, is the currently preferred photoelectron emitting substance; however, other suitable photocathode materials include the following substances:

| Substance | Long Wavelength cut-off point (nm) |
|---|---|
| Sodium chloride (NaCl) | 150 |
| Potassium bromide (KBr) | 155 |
| Rubidium iodide (RbI) | 185 |
| Cuprous chloride (CuCl) | 190 |
| Copper/Beryllium (Cu/Be) | 200 |
| Copper Iodide (CuI) | 210 |
| Rubidium telluride ($RbTe_2$) | 300 |
| Cesium telluride ($CS_2Te$) | 350 |

The mesh electrode 14 may be formed from a mesh commercially available from Buckbee-Mears designated "MN-8" formed by 50 μm wide wires with 800 μm pitch and exhibiting 90% optical transmission. The photocathode 12 is supported in spaced parallel relationship with one end wall of a cylindrical leak-tight vessel 16 by an annular-shaped ceramic spacer 18, and mesh electrode 14 is supported parallel to the opposite end wall, and to the photocathode, by an annular-shaped ceramic spacer 20. The photocathode 12 and mesh electrode 14 are electrically connected to external circuitry via feed-through insulators 22 and 24, respectively, fitted in a wall of vessel 16. Feedthrough insulator 22 is preferably rated at 2 kV to withstand the high D.C. potential required for operation of the lamp. An opening, preferably circular, in the end wall of the vessel adjacent which the mesh electrode 14 is supported, is fitted with a window 26 which is transparent down to the shortest wavelengths of the light emitted by the lamp. The window material may be cultured quartz crystal with short wavelength cutoff at approximately 160 nm, or calcium fluoride (CaF) crystal, which is transparent down to 120 nm. Other suitable VUV-transparent window materials include $MgF_2$, LiF and sapphire.

The vessel 16 is provided with a valve 28 and suitable piping for evacuating the vessel of air and then filling it with a rare gas at low pressure, xenon, krypton and argon all being suitable; a pressure of a few hundred Torr is typical.

The lamp is powered by a power supply 30, represented as a battery 32, the positive terminal of which is connected to ground and also to screen electrode 14 of the lamp, and the negative terminal of which is connected via a ballistic resistor 34, typically having a value of one megohm, to the photocathode 12. Of course, the high voltage may be applied to either electrode so long as its polarity is correct.

The high positive potential of the mesh electrode relative to the photocathode, which may be on the order of 680 to 800 volts, creates an electric field which drifts free electrons emitted from photocathode 12, and by the combined effect of field-driven scintillation amplification sustained by photon positive feedback mediated by photoemission from the photocathode, produces continuous VUV light output through window 26.

Scintillation amplification in rare gases is a well-known electroluminescent process. Rare gases having no vibrational or rotational states, excitation is required to excite the atom to the lowest electronic excited state, at around 10 electron volts. When an electric field is created between two spaced electrodes in a gas-filled vessel, any free electrons in the gap between the electrodes is drifted and undergoes many nonradiative elastic scattering collisions before gaining enough kinetic energy from the field to create an excited atom. Postulating that $E_{exc}$ is the threshold value of the electric field for light emission from atoms of a given rare gas, and $E_{ion}$ is the threshold for ionization of the given gas, if the applied field E is uniform, which occurs when using spaced parallel electrodes, and has a value less than $E_{ion}$ but greater than $E_{exc}$ (i.e., $E_{ion}>E>E_{exc}$) the emitted light corresponds only to the drifting of primary electrons, and neither secondary electrons nor ions are produced. Thus, the processes of energy transfer in rare gases are characterized by lack of vibration excitation and excitation leading to photon emission over a wide range of values of applied field E and gas pressure p (i.e., E/p) before ionization occurs. It has been estimated by investigators in the field, that in pure rare gases as much as 75 to 97% of the energy gained by the electrons from the electric field is converted into light. Deexcitation of the excited atoms R* to produce light generally is a two-step process: collisions with neutral atoms produce a molecular rare gas excimer, $R^*_2$, and this excimer then deexcites by breaking up into two ground-state atoms and an emitted photon. This photon lies in the VUV region of the spectrum. Scintillation amplification is described by the parameter $\alpha_s$, the number of scintillation photons per unit length induced by one electron drifting through the medium in the direction of the field.

The photocathode 12 functions as a photon-electron converter, or a photo-emitter, which is based on the well-known photoelectric effect. The quantum efficiency (QE) of the photocathode is defined as the ratio of the number of emitted photoelectrons to the number of incident photons and is mainly dependent on its fabrication and treatment. Cesium iodide (CsI) is an excellent VUV-sensitive photocathode material, currently recognized as the best discovered so far, with a very high QE. It is expected that current intense research activity in the field will yield other photoemitters useful for the practice of the invention. The effective QE of a photocathode placed in a gas medium, especially one of the rare gases, is lowered due to electron backscattering by the atoms and, therefore, exhibits an apparent quantum efficiency $\phi_a$. A photocathode material having high QE is essential to the success of the light source of the invention. GaAs is a well-known semiconductor photoemitter which can be added to the list.

The simple combination of the described scintillation amplification effect and photoelectric effect in a rare gas environment results in very efficient, self-triggered and self-sustained energy transfer and makes possible the generation of light in the VUV region of the spectrum. With knowledge of these two physical processes, the mechanism by which light is produced can easily be described.

Figure 2:
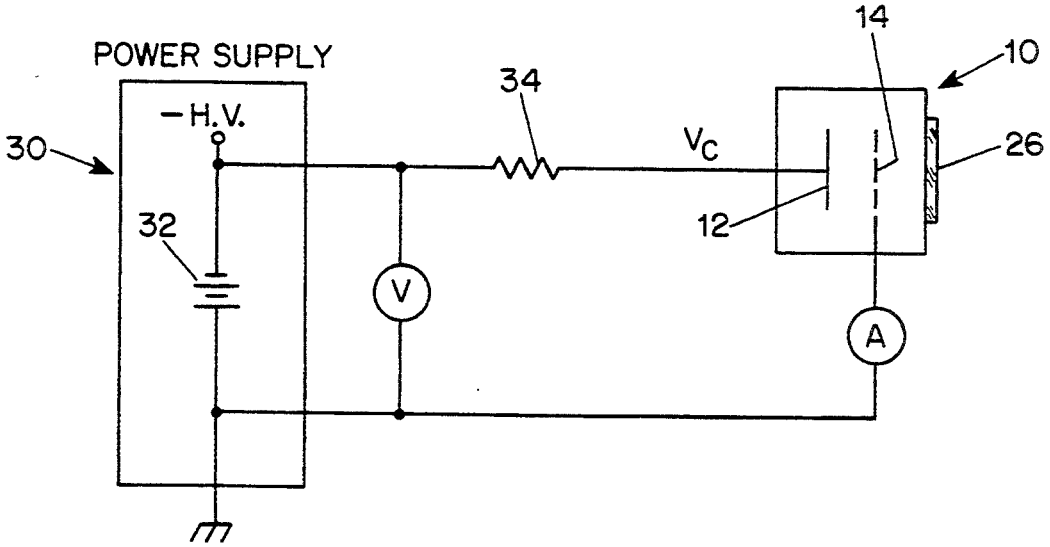
FIG. 2 is a schematic circuit diagram of external circuitry for powering the lamp shown in FIG. 1.

With reference to FIGS. 1 and 2, upon application of a high voltage across the gap defined by photocathode 12 and mesh electrode 14, electrons occurring in the gap are drifted in a direction away from the photocathode and gain sufficient energy from the electric field to excite the rare gas atoms. The excited atoms form excimers by collisions with other neutral atoms, and the de-excitation of the excimers gives out VUV photons. While some photons emitted from the excimers pass through mesh electrode 14 and output window 26 as output of the lamp, others are returned to the photocathode and eject more electrons into the gas to sustain the process by positive photon feedback.

The scintillation amplification increases with the applied electric field and, therefore, with the applied voltage. When the applied voltage is lower than a critical value $V_c$, zero current flows through the gap. When the applied voltage equals or exceeds $V_c$, defined as the voltage at which an electron has loop gain $g=\Phi_a\alpha_s d$ equal to one, where d is the spacing between the photocathode and the mesh electrode, any free electrons inside the gap trigger an avalanche-like process and flow of current in the gap. Because applied voltages which exceed $V_c$ appear to cause the current to increase without limit, the current is limited by the ballistic resistor 34 which, as noted earlier, may have a value of 1

Megohm. While the voltage across resistor 34 increases with the gap current, the voltage applied to the lighting gap is fixed at approximately $V_c$. Therefore, the current through the gap is limited and determined by the resistance of resistor 34 and the voltage V of the power supply 30.

Figure 3:
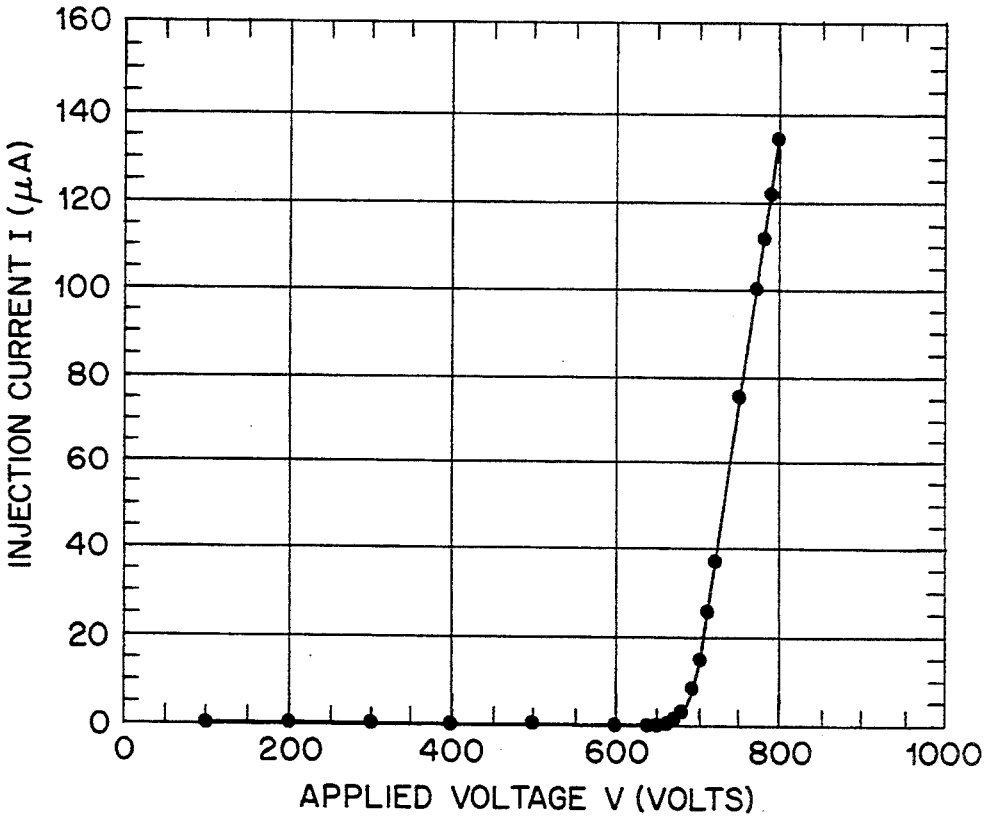
FIG. 3 is a graph showing the relationship between lamp injection current and applied voltage.

A lamp in which electrodes spaced by about 5 mm are supported in a vessel containing xenon gas at a pressure of 260 Torr and energized from the circuit shown in FIG. 2 having the component values indicated earlier, has the ohmic current vs. voltage characteristic shown in FIG. 3. It is seen that an applied voltage of about 640 volts is required to initiate current flow through the gap, and that the current increases linearly with applied voltage, over the range from 680 to 800 volts, from about 6 $\mu$A to about 135 $\mu$A.

While the data plotted in FIG. 3 shows values of injection current up to 135 $\mu$A, injection currents of up to 300 $\mu$A have been achieved in a protype lamp constructed in accordance with FIG. 1. Considering that total photons should outnumber total photoelectrons, and if an apparent quantum efficiency of about 0.1 is assumed, it can be estimated that the VUV photon flux is on the order of $10^{16}$ to $10^{18}$ photons/second with a power consumption of only 0.3 watt, as compared to the photon flux of $10^{16}$ photons/second typically produced by microwave-powered VUV lamps and the power consumption of a few hundred watts by most of the discharge lamps.

Figure 4:
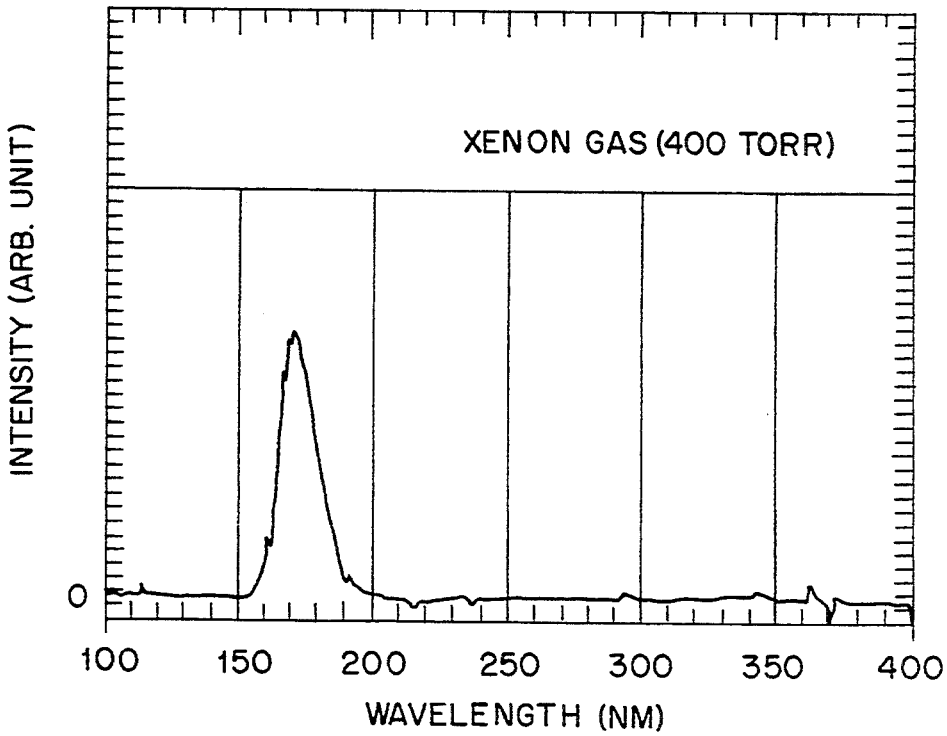
FIG. 4 is the emission spectrum of a lamp constructed according to FIG. 1 containing xenon at a pressure of 400 Torr.

The spectral distribution of the output of a lamp constructed in accordance with FIG. 1 containing xenon gas at a pressure of 400 Torr, measured with an UV monochromator and an UV-sensitive photomultiplier is shown in FIG. 4. The emission continuum lies narrowly in the vacuum ultraviolet region around 175 nm, consistent with the xenon scintillation continuum, but different from the xenon discharge continuum published in the literature, lying in the UVU around 150–200 nm but with two continuum components.

The lamp according to the invention is operable over a range of gas pressures. The working pressure p, the applied voltage V and the electrode spacing d are related to each other so that to satisfy the lighting condition $\Phi_a.\alpha_s.d=1$, $\Phi_a$ and $\alpha_s$ depend on E/p and, therefore, on V/dp. Because each individual photocathode has its own QE depending on the preparation conditions, the optimum operations conditions such as working pressure and applied voltage will be determined by the geometry of the electrodes and the quality of the individual photoemitter. Usually, if the pressure is too low the dynamic range of the scintillation amplification is too narrow, and therefore there is risk of entering the discharge region. On the other hand, higher pressure can increase the dynamic range, but reduces the QE due to the larger back scattering loss and the applied electric field has to increase to achieve the necessary amplification.

The spacing of the electrodes may be varied over a narrow range, typically about 2 mm to about 5 mm; the spacing can be increased, but is limited by the rating of the high voltage feedthrough insulators. Larger spacing requires higher applied voltage in order to produce the required higher electric field.

Thus, the invention provides a light source of relatively simple construction, which utilizes a novel combination of mechanisms in rare gases not previously used together, to efficiently produce vacuum ultraviolet light having a wavelength around 175 nm and a photon flux on the order of $10^{16}$ to $10^{18}$ photons/second in the case of xenon gas. The lamp produces a uniform photon flux over any desired large area, and the output is narrow-band in VUV so as to not need UV filtering, properties which would appear to provide a solution to the difficulties currently being encountered by the semiconductor industry in developing photolithographic equipment capable of producing ever smaller integrated circuits.

While a specific embodiment has been shown and described to explain the principles of operation of the inventive light source, it is to be understood that modifications can be made without departing from the spirit and scope of the invention. For example, while the illustrated test results were obtained with a xenon-filled lamp, comparable performance can be expected and actually have been tested using other rare gases, including argon and krypton. As known so far, it has been reported in the literature that only Ar, Kr and Xe give strong scintillation amplification effect in the range from 10 to about 760 Torr, with Helium and Neon exhibiting only little effect. However, it is within the contemplation of the invention to use any of these gases, any new gases, and their mixtures which have strong scintillation properties.

Some variation in the electrode structure is also contemplated; for example, another mesh may be disposed between the two electrodes shown in FIG. 1 to form a three-electrode structure (which may be termed a "Photontriode"). The potentials applied to the three electrodes are such that the added mesh is transparent to the electrons from the photoemitter. The added mesh separates the lighting region from the drifting region near the photoemitter and will protect the photoemitter from ion bombardment in the event of discharge.

We claim:

1. A source of light in the vacuum ultraviolet (VUV) spectral region, comprising:

a vessel containing a rare gas, said vessel having an output window which is substantially transparent to light in the VUV spectral region;

first and second electrodes supported within said vessel in parallel spaced relationship, wherein said first electrode is an ultraviolet-sensitive photocathode and said second electrode is a mesh electrode; and means for applying to said mesh electrode a positive potential relative to said photocathode sufficiently high to create an electric field between said first and second electrodes for causing drifting of free electrons occurring between said electrodes and producing continuous VUV light output by electric field-driven scintillation amplification sustained by positive photon feedback mediated by photoemission from said photocathode.

2. Light source according to claim 1, wherein said rare gas is selected from the group of rare gases consisting of argon, krypton and xenon.

3. Light source according to claim 1, wherein the emitting substance of said photocathode is cesium iodide (CsI).

4. Light source according to claim 1, wherein said potential-applying means includes a resistor for limiting injection current of said light source, and wherein the injection current is substantially linearly proportional to applied potential over a range between about 670 volts and about 800 volts.

5. Light source according to claim 4, wherein said rare gas is xenon at a pressure of about 260 Torr, wherein the spacing between said first and second electrodes is about 5 mm, and wherein said photocathode is cesium iodide.

6. Light source according to claim 1, wherein said rare gas is xenon at a pressure of 400 Torr, said photocathode is cesium iodide and produces an emission continuum lying narrowly in the VUV spectral region around 175 nm.

7. Light source according to claim 1, wherein said output window is formed of cultured quartz crystal having short wavelength cutoff at about 160 nm.

8. Light source according to claim 1, wherein said output window is formed of calcium fluoride crystal and transparent down to a short wavelength cutoff at about 120 nm.

9. A light source for producing light in the vacuum ultraviolet (VUV) spectral region by electric field-driven scintillation amplification, sustained by positive photon feedback mediated by photoemission from the photocathode comprising:

a vessel having an output window substantially transparent to VUV light and containing a rare gas at low pressure;

a planar mesh electrode supported within said vessel adjacent said output window;

an ultraviolet sensitive photocathode spaced from and facing said planar mesh electrode; and means for connecting a source of voltage between said photocathode and said mesh electrode to thereby create said electric field.

10. Light source according to claim 9, wherein said rare gas is selected from the group including argon, krypton and xenon.

11. Light source according to claim 9, wherein the emitting substance of said photocathode is selected from the group of photoelectron emitting substances including sodium chloride (NaCl), potassium bromide (KBr), rubidium iodide (RbI), cuprous chloride (CuCl), cesium iodide (CsI), copper/beryllium (Cu/Be) and copper iodide (CuI).

12. Light source according to claim 9, wherein the emitting substance of said photocathode is cesium iodide (CsI).

13. Light source according to claim 10, wherein the spacing between said photocathode and said mesh electrode is in the range from about 2 mm to about 5 mm, and wherein the pressure of said rare gas is in the range from about 10 Torr to about 1000 Torr.

14. Light source according to claim 9, wherein said photocathode and said mesh electrode are supported parallel to each other, and wherein the spacing therebetween is in the range from about 2 mm to about 5 mm.

15. Light source according to claim 14, wherein the pressure of said rare gas is in the range from about 10 Torr to about 1000 Torr.

16. Method for producing light in the vacuum ultraviolet (VUV) spectral region comprising the steps of:

providing a lamp having a reflective ultraviolet- sensitive photocathode facing and spaced from a mesh electrode in a low pressure rare gas medium; and applying to said mesh electrode a potential which is positive relative to a potential applied to said photocathode sufficiently high to create an electric field between said photocathode and said mesh electrode for drifting free electrons occurring in the space therebetween and producing a continuous VUV light output through said mesh electrode by electric field-driven scintillation amplification sustained by positive photon feedback mediated by photoemission from said photocathode.

17. Method for producing VUV light according to claim 16, wherein the pressure of said rare gas medium is in the range from about 10 Torr to about 1000 Torr.

18. Method for producing VUV light according to claim 16, wherein the current of said lamp injected by application of said potential is limited by a ballistic resistor so as to vary substantially linearly with applied potential.

19. Method for producing VUV light according to claim 17, wherein said rare gas is selected from the group consisting of argon, krypton and xenon.

* * * * *

UNITED STATES PATENT AND TRADEMARK OFFICE

CERTIFICATE OF CORRECTION

PATENT NO. : 5,418,424

DATED : May 23, 1995

INVENTOR(S) : Elena Aprile et al.

It is certified that error appears in the above-indentified patent and that said Letters Patent is hereby corrected as shown below:

On the title page; col. 1, after "Inventors," insert -- Assignee: The Trustees of Columbia University in the City of New York, New York, N.Y." --;

col. 2, before "ABSTRACT," there should be inserted -- Attorney, Agent, or Firm – Brumbaugh, Graves, Donohue & Raymond --.

Signed and Sealed this

Thirtieth Day of July, 1996

Bruce Lehman

*Attest:*

BRUCE LEHMAN

*Attesting Officer*

*Commissioner of Patents and Trademarks*